US005647770A

United States Patent [19]

Belopolsky

[11] Patent Number: 5,647,770

[45] Date of Patent: Jul. 15, 1997

[54] INSERT FOR A MODULAR JACK USEFUL FOR REDUCING ELECTRICAL CROSSTALK

[75] Inventor: Yakov Belopolsky, Harrisburg, Pa.

[73] Assignee: Berg Technology, Inc., Reno, Nev.

[21] Appl. No.: 580,943

[22] Filed: Dec. 29, 1995

[51] Int. Cl.[6] ..... H01R 23/02

[52] U.S. Cl. ..... 439/676; 439/941

[58] Field of Search ..... 439/676, 941, 439/344, 607

[56] References Cited

U.S. PATENT DOCUMENTS

| | | | |
|---|---|---|---|
| T961,003 | 8/1977 | Krumreich | 439/676 |
| 4,274,691 | 6/1981 | Abernethy et al. | 439/676 |
| 4,734,043 | 3/1988 | Emert et al. | 439/676 |
| 5,094,631 | 3/1992 | Suzuki | 439/676 |
| 5,282,754 | 2/1994 | Kish et al. | 439/108 |
| 5,362,257 | 11/1994 | Neal et al. | 439/676 |
| 5,399,107 | 3/1995 | Gentry | 439/676 |
| 5,456,619 | 10/1995 | Belopolsky et al. | 439/676 |
| 5,547,405 | 8/1996 | Pinney et al. | 439/676 |

*Primary Examiner*—David L. Pirlot
*Assistant Examiner*—Tho Dac Ta
*Attorney, Agent, or Firm*—Daniel J. Long, Esq.; M. Richard Page, Esq.

[57] ABSTRACT

An insert for a modular jack assembly insert comprising an insulative member having top and bottom walls; a front end and a rear recess; a first wire extending from adjacent the bottom wall of the insulative member across the rear recess to the top wall and then through the front end of the insulative member; and a second wire extending from adjacent the bottom wall of the insulative member across the rear recess in non-contacting, overlapping relation with the first wire. Also a modular jack assembly insert comprising an insulative member having a top and a bottom wall and a front end; a first wire extending in a first vertical plane from adjacent the bottom wall toward the top wall and then extend toward the front wall in a first horizontal plane; and a second wire extending in a second vertical plane from adjacent the bottom wall toward the top in a pattern such that at least two points on the second wire are in a common third vertical plane with two points on said first wire and then extends toward the front wall in a second horizontal plane. Surprising and unexpected reductions in electrical crosstalk are achieved with this insert.

8 Claims, 6 Drawing Sheets

INSERT FOR A MODULAR JACK USEFUL FOR REDUCING ELECTRICAL CROSSTALK

BACKGROUND OF THE INVENTION

1. Field of the Invention

The present invention relates to electrical connectors and more particularly to modular jacks for use in telecommunications equipment.

2. Brief Description of Prior Developments

Modular jacks are used in two broad categories of signal transmission: analog (voice) and digital (data) transmission. These categories can overlap somewhat since digital systems are used for voice transmission as well. Nevertheless, there is a significant difference in the amount of data transmitted by a system per second. A low speed system would ordinarily transmit from about 10 to 16 megabites per second (Mbps), while a high speed system should be able to handle 155 Mbps or even higher data transfer speeds. Often, high speed installations are based on asynchronous transfer mode transmission and utilize shielded and unshielded twisted pair cables.

With recent increases in the speed of data transmission, requirements have become important for electrical connectors, in particular, with regard to the reduction or elimination of crosstalk. Crosstalk is a phenomena in which a part of the electromagnetic energy transmitted through one of multiple conductors in a connector causes electrical currents in the other conductors.

Another factor which must be considered is that the telecommunications industry has reached a high degree of standardization in modular jack design. Outlines and contact areas are essentially fixed and have to be interchangeable with other designs. It is, therefore, important that any novel modular jack allow with only minor modification, the use of conventional parts or tooling in its production.

There is, therefore, a need for a modular jack insert which will reduce or eliminate crosstalk in telecommunications equipment.

There is also a need for such a modular jack insert which can reduce or eliminate crosstalk and common mode interference which is interchangeable with prior art modular jacks and which may be manufactured using conventional parts and tooling.

SUMMARY OF THE INVENTION

The present invention consists of an insert for a modular jack assembly which, surprisingly and unexpectantly, reduces electrical cross talk.

In the insert of the present invention there is an insulative housing having a top and bottom walls, lateral walls, a front end and a rear recess. A pair of wires extend from the bottom wall to the top wall and then horizontally through the front end in non-contacting overlapping relation. One of these wires extends upwardly beyond the upper end of the other wire. Another wire is positioned in generally parallel non-overlapping, non-contacting arrangements with these two other wires and this third wire also extends from the bottom wall to the top wall and then horizontally through the front end wall at a point which is in space vertical relation above the first wire. The first and second wires will also be in separate vertical planes while the third wire may share common plane with the second wire otherwise may be used in the modular jacking conventional manner.

In a second embodiment of this insert, a first wire extends from the bottom wall, first vertically then diagonally in a first vertical plane to an upper point at which it extends horizontally toward the front end. A second wire extends in a vertical plane. In a second vertical plane from the bottom wall to a point above the upper point of the first wire and then extends diagonally upwardly to a point where it extends horizontally toward the front end so that the wires are non-contacting and non-overlapping in their respective vertical planes. A third wire extends from the bottom wall toward the top wall further than the upper end of the first wire and then also extends toward the front end. Other wires may be positioned conventionally and generally parallel arrangement such that the top ends will be in a generally common horizontal plane with the top end of the first wire.

BRIEF DESCRIPTION OF THE DRAWINGS

The insert of the present invention is further described with reference to the accompanying drawings in which.

DETAILED DESCRIPTION OF THE PREFERRED EMBODIMENTS

Figure 1:
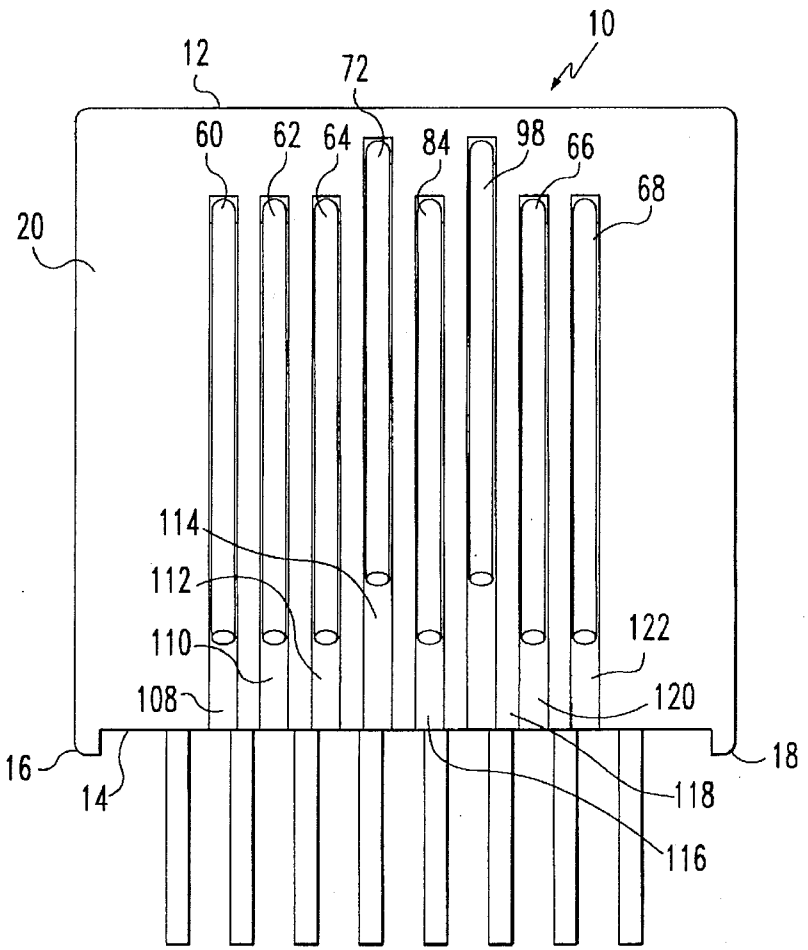
FIG. 1 is a front elevational view of a preferred embodiment of the modular jack contact insert of the present invention.
Figure 3:
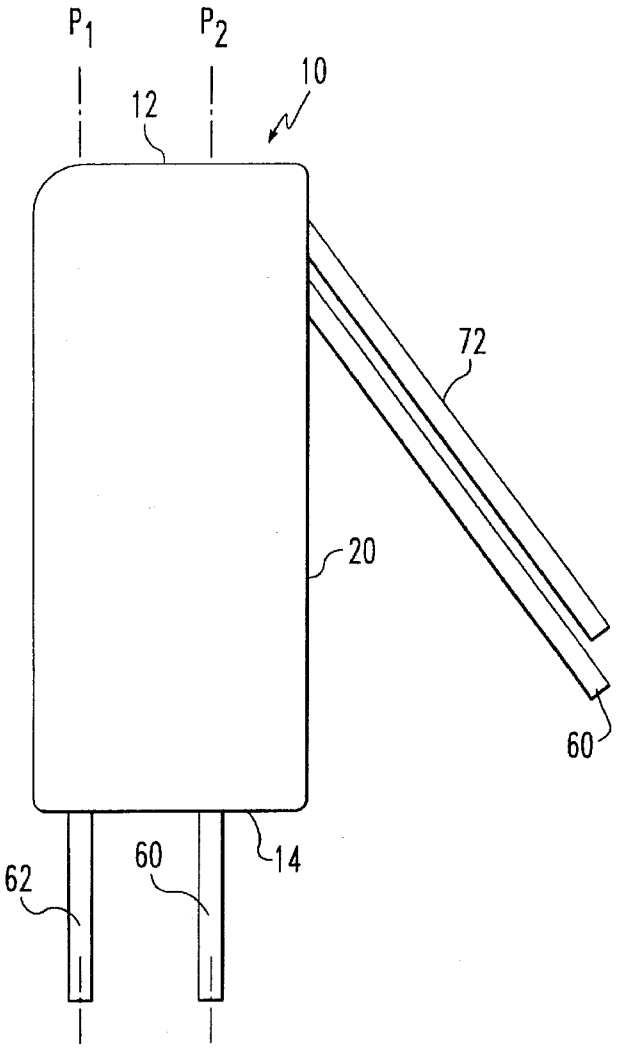
FIG. 3 is a side elevational view of the contact insert shown in FIG. 1.
Figure 2:
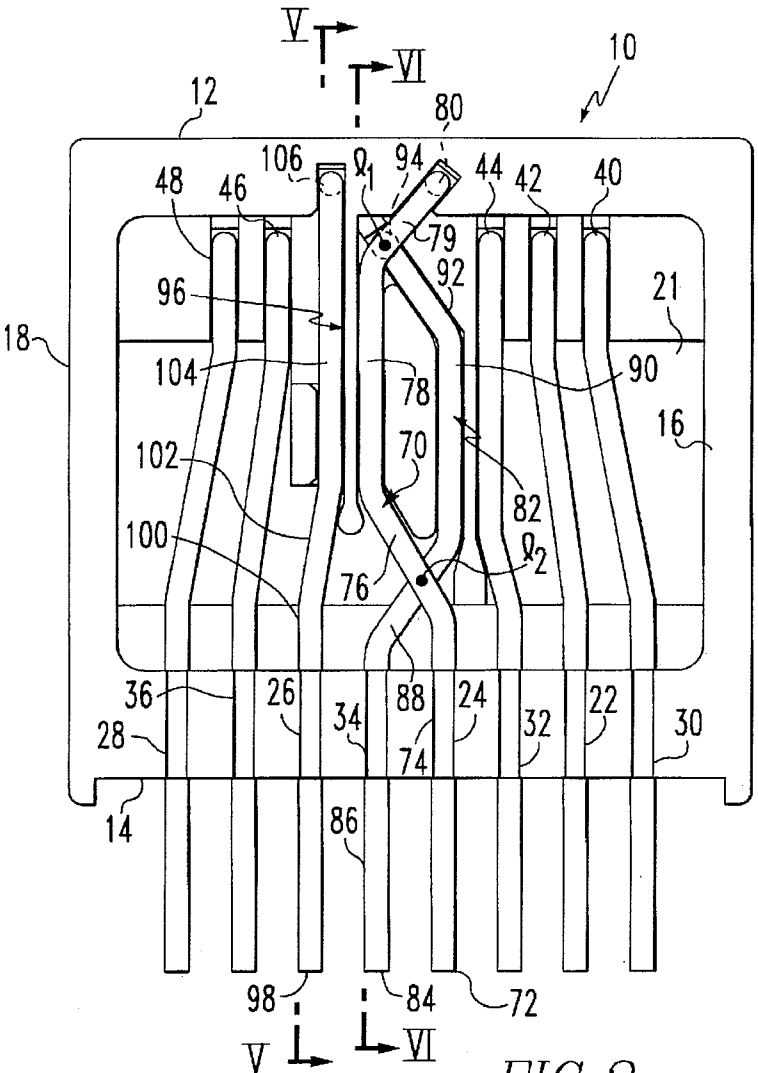
FIG. 2 is a rear elevational view of the contact insert shown in FIG. 1.
Figure 5:
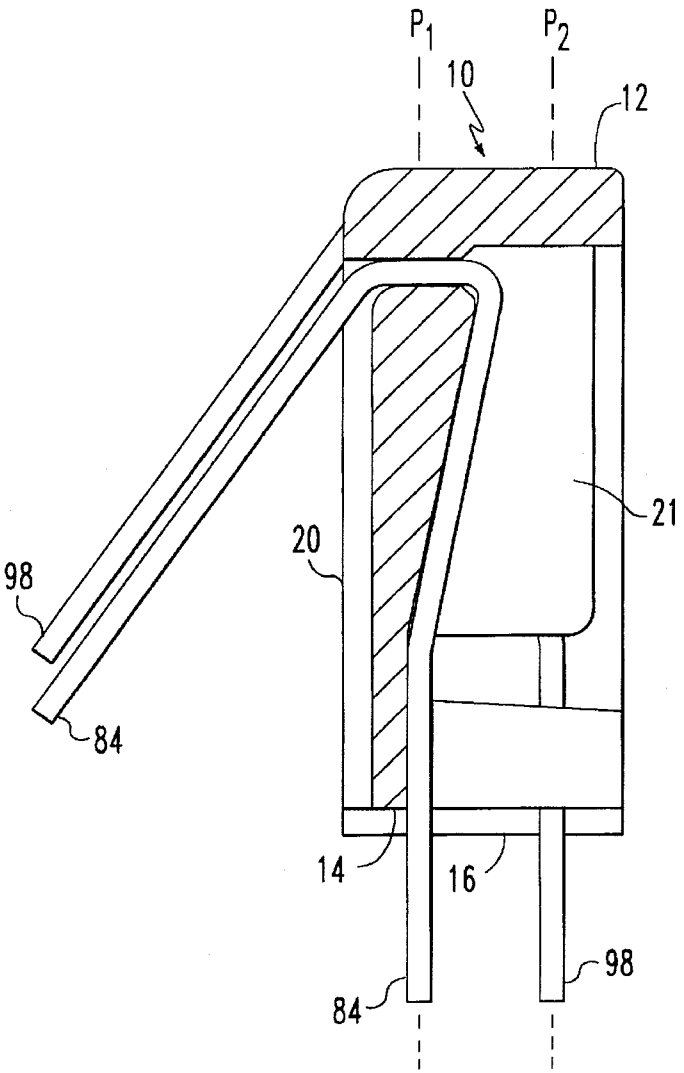
FIG. 5 is a cross sectional view through V—V in FIG. 2.
Figure 6:
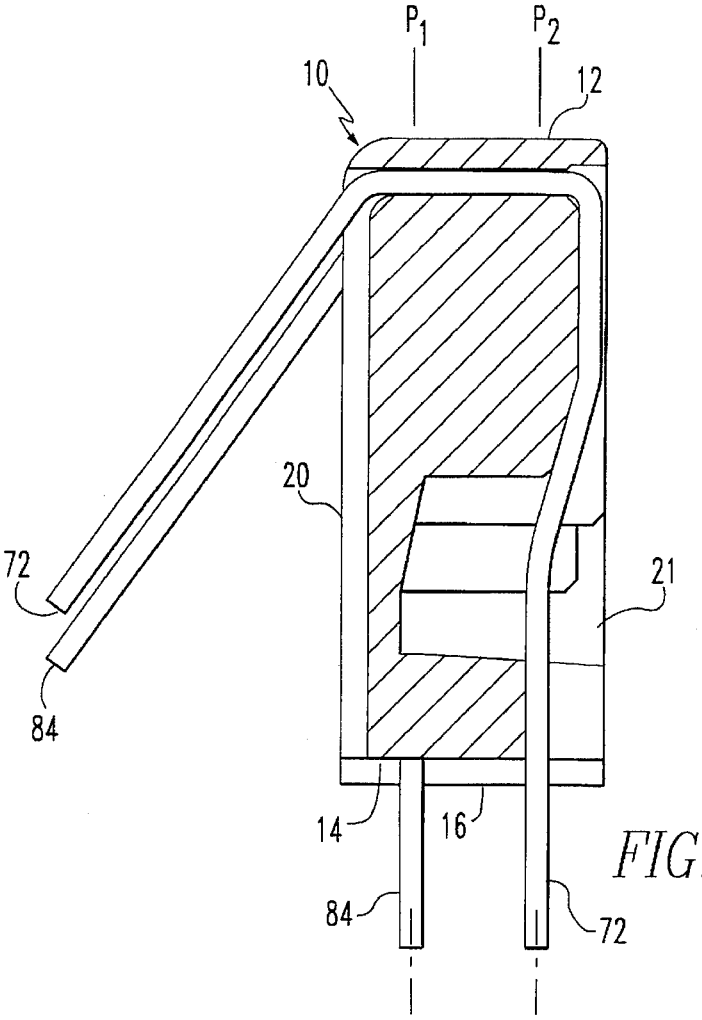
FIG. 6 is a cross sectional view through VI—VI in FIG. 2.
Figure 4:
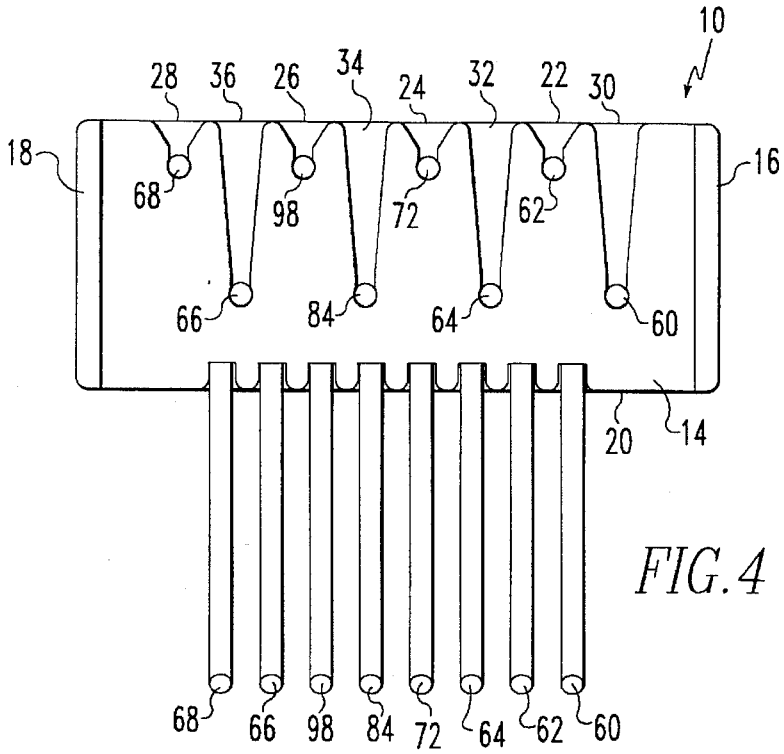
FIG. 4 is a bottom plan view of the modular jack insert shown in FIG. 1.
Figure 7:
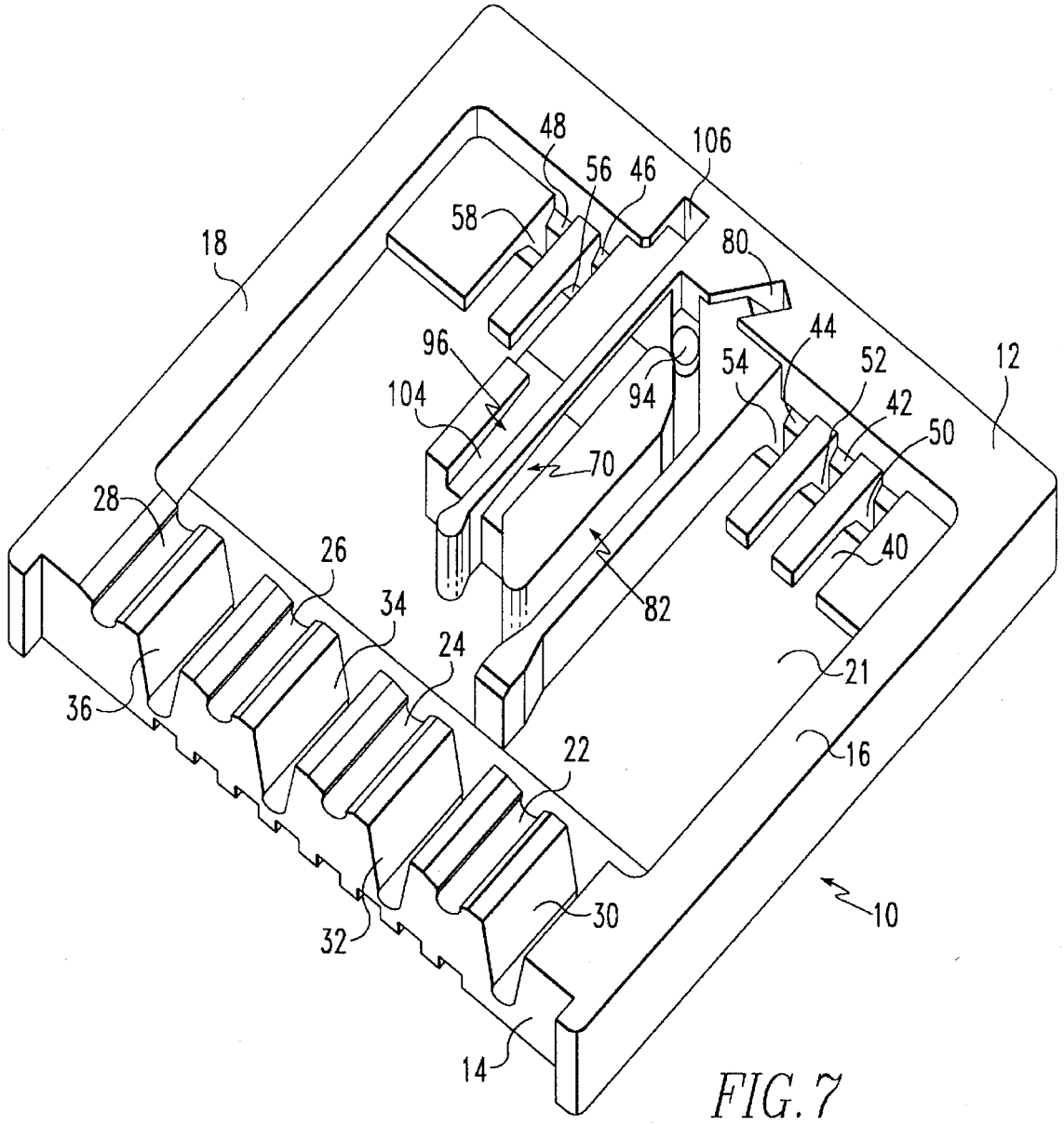
FIG. 7 is a rear perspective view of the insulative member section of the modular jack insert shown in FIG. 1.
Figure 8:
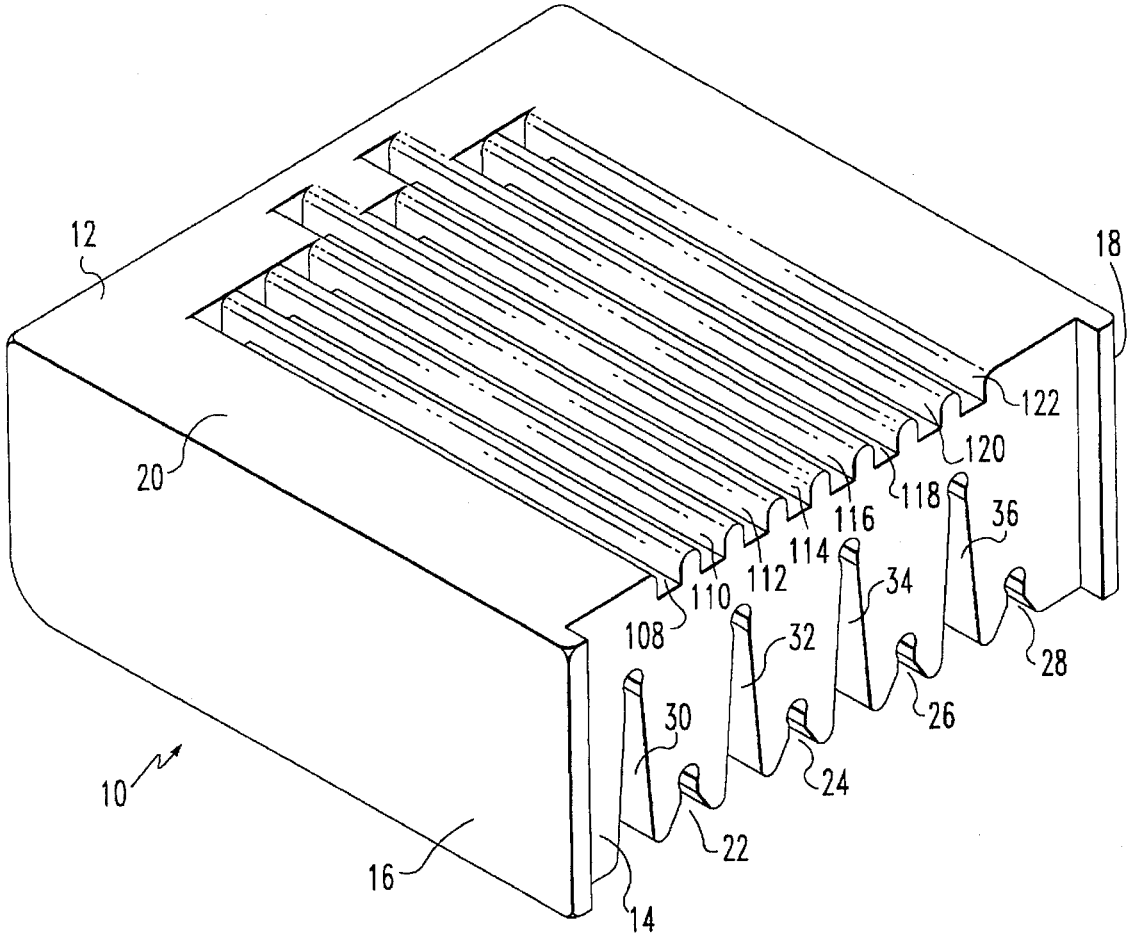
FIG. 8 is a front perspective view of the insulative member section of the modular jack insert shown in FIG. 1.

Referring to FIGS. 1–8, a modular jack insert includes an insulative member shown generally at numeral 10. The insert is received in an insulative housing (not shown) to form a completed modular jack. The insert may have wide uses, but it is believed that it may be of particular use with a housing intended to meet standards 568.A and 568.B of the Electronics Industry Association. The insulative member section of the insert includes a top wall 12, a bottom wall 14, lateral walls 16 and 18 and a front end wall 20. The top wall 12, bottom wall 14, lateral walls 16 and 18 and front wall 20 together form a rear recess 21. On the bottom wall there are an upper row of wire receiving grooves 22, 24, 26 and 28. There are also a more deeply recessed lower row of wire receiving grooves 30, 32, 34, and 36. It will be appreciated that the wires engaged with the lower row of wire receiving grooves and the wires engaged with the upper row of wire receiving grooves will be in separate vertical planes $p_1$ and $p_2$, respectively. On the upper wall there are lower wire receiving grooves 40, 42, 44, 46 and 48. These wire receiving grooves connect to lateral upper horizontal apertures 50, 52, 54, 56 and 58. These lateral wire receiving grooves and apertures hold lower wires 60, 62, 64, 66 and 68. There is also a first medial passageway shown generally at numeral 70 which receives first medial wire 72. This passageway conducts the first medial wire upwardly from the bottom wall toward the top wall in a vertical leg 74, a diagonal leg 76, another vertical leg 78 and another diagonal leg 79 to a first medial horizontal aperture 80 which conducts the first medial wire through the front end wall. There is also a second medial passageway shown generally at numeral 82 which conducts a second medial wire 84 from the bottom wall toward the top wall in a vertical leg 86, a diagonal leg 88, another vertical leg 90 and another diagonal leg 92 which conveys the wire to a second medial horizontal aperture 94 that conveys the wire through the front end wall. It will be appreciated that wires 72 and 84 are in separate vertical planes, and that wire 72 overlaps wire 84 at two points so that two separate horizontal lines ($l_1$ and $l_2$ in FIG. 2) pass through both wires. It will also be appreciated that wires 72 and 98 are in a common vertical plane. There is also a third medial passageway shown generally at numeral 96 which conducts a third medial wire 98 in a vertical leg 100, a diagonal leg 102 and another vertical leg 104 to a third horizontal aperture 106 which conveys this wire through the front end wall. Referring particularly to FIG. 8, it will also be seen that on the front end wall there are a number of vertical grooves 108, 110, 112, 114, 116, 118, 120, and 122. These vertical grooves receive, respectively, wires 60, 62, 64, 72, 84, 98, 66 and 68.

Figure 9:
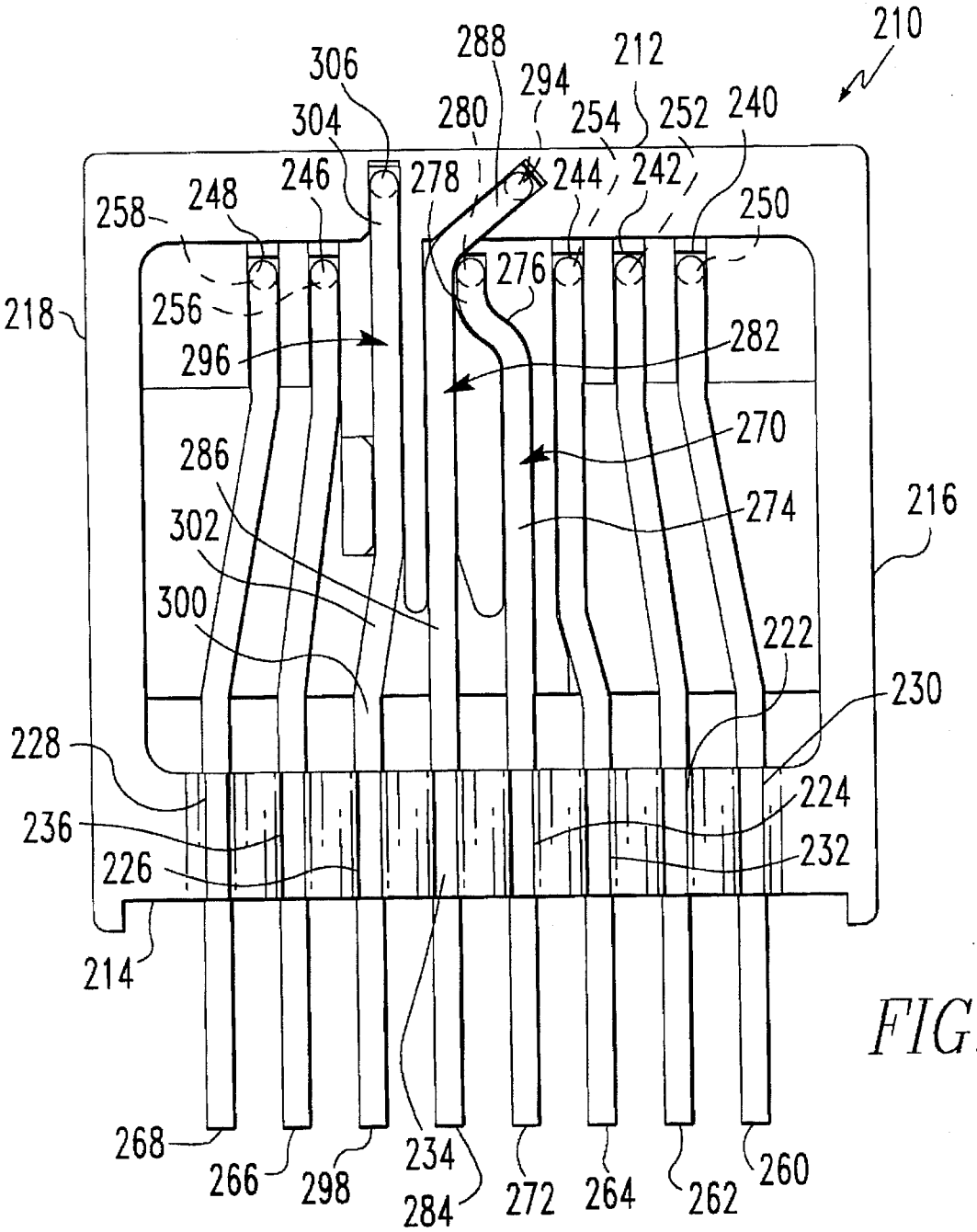
FIG. 9 is a rear elevational view similar to FIG. 6 of a modular jack insert representing an alternate preferred embodiment of the present invention.

Referring to FIGS. 9, the insulative member of a second preferred embodiment of the insert is shown generally at numeral 210. The insulative member of a second preferred embodiment of the includes a top wall 212, a bottom wall 214, lateral walls 216 and 218 and a front end wall. The top wall 212, bottom wall 214, lateral walls 216 and 218 and front wall 220 together form a rear recess 221. On the bottom wall there are an upper row of wire receiving grooves 222, 224, 226 and 228. There are also a more deeply recessed lower row of wire receiving grooves 230, 232, 234, 236 and 238. On the upper wall there are lateral wire receiving grooves 240, 242, 244, 246 and 248. These wire receiving grooves connect to lateral upper horizontal apertures 250, 252, 254, 256 and 258 from where they extend diagonally downward. These lower wire receiving grooves and apertures hold lower wires 260, 262, 264, 266 and 268. There is also a first medial passageway shown generally at numeral 270 which receives first medial wire 272. This passageway conducts the first medial wire upwardly from the bottom wall toward the top wall in a vertical leg 274, a diagonal leg 276 and another vertical leg 278 to a first medial horizontal aperture 280 which conducts the first medial wire through the front end wall from where it extends diagonally downward. There is also a second medial passageway shown generally at numeral 282 which conducts a second medial wire 284 from the bottom wall toward the top wall in a vertical leg 286 and a diagonal leg 288 which conveys the wire to a second medial horizontal aperture 294 that conveys the wire through the front end wall from where it extends diagonally downward. It will be appreciated that wires 272 and 284 are in separate vertical planes and that they are in non-contacting, non-overlapping relation. It will also be appreciated that wires 272 and 298 are in a common vertical plane. There is also a third medial passageway shown generally at numeral 296 which conducts a third medial wire 298 in a vertical leg 300, a diagonal leg 302 and another vertical leg 304 to a third horizontal aperture 306 which conveys this wire through the front end wall from where it extends diagonally downwardly. As was described in connection with the first embodiment, there are vertical grooves on the front side in which the wires extending diagonally from the front end are receivable.

With the above described modular jack assembly insert, surprising and unexpected reductions in electrical crosstalk may be efficiently and economically obtained. It will also be appreciated that this insert may be readily designed to be backward compatible with existing parts and tooling.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An insert for a modular jack assembly comprising:

(a) an insulative member having a top wall and a bottom wall and a front end;

(b) a first conductive means having a vertical leg extending in a first vertical plane from adjacent the bottom wall toward the top wall and then extending diagonally in said first vertical plane in a diagonal leg to a first upper point from where it extends in a horizontal leg toward the front end; and (c) a second conductive means having a vertical leg extending in a second vertical plane from adjacent the bottom wall toward the top wall further than the first upper point and then extending diagonally in a diagonal leg in the second vertical plane to a second upper point from where it extends in a horizontal leg toward the front end.

2. The modular jack assembly insert of claim 1 wherein vertical and diagonal legs of the first and second conductive means are not overlapping.

3. The modular jack assembly insert of claim 2 wherein the diagonal leg of the first conductive means extends toward the second conductive means.

4. The modular jack assembly insert of claim 2 wherein the diagonal leg of the second conductive means extends in a direction so that the horizontal leg of the second conductive means is superimposed over at least part of the first conductive means.

5. The modular jack assembly insert of claim 4 wherein there is a third conductive means which extends from adjacent the bottom wall further than the first conductive means and then extends toward the front end.

6. The modular jack assembly insert of claim 5 wherein the third conductive means extends from adjacent the bottom wall toward the top wall in the second vertical plane.

7. An insert for a modular jack assembly comprising:

(a) an insulative member having top and bottom walls, a front end and a rear recess;

(b) a first conductive means extending from adjacent the bottom wall of the insulative member across the rear recess to the top wall and then through the front end of the member and said first conductive means has a vertical leg extending in a first vertical plane from adjacent the bottom wall toward the top wall and then extends diagonally in said first vertical plane in a diagonal leg to a first upper point from where it extends in a horizontal leg toward the front end; and (c) a second conductive means extending from adjacent the bottom wall of the insulative member across the rear recess in non-contacting relation with said first conductive means and extending beyond the first conductive means.

8. The modular jack assembly insert of claim 7 wherein the second conductive means has a vertical leg extending in a second vertical plane from adjacent the bottom wall toward the top wall further than the first upper point and then extending diagonally in a diagonal leg in the second vertical plane toward the front end.

* * * * *